US008181951B2

(12) United States Patent
Betto et al.

(10) Patent No.: US 8,181,951 B2
(45) Date of Patent: May 22, 2012

(54) IMAGE FORMING APPARATUS

(75) Inventors: Kazushi Betto, Wakayama (JP); Seiji Minamiyama, Wakayama (JP)

(73) Assignee: Noritsu Koki Co., Ltd., Wakayama (JP)

( * ) Notice: Subject to any disclaimer, the term of this patent is extended or adjusted under 35 U.S.C. 154(b) by 44 days.

(21) Appl. No.: 12/903,557

(22) Filed: Oct. 13, 2010

(65) Prior Publication Data

US 2011/0089626 A1 Apr. 21, 2011

(30) Foreign Application Priority Data

Oct. 19, 2009 (JP) ..... 2009-240097

(51) Int. Cl.
*B65H 85/00* (2006.01)

(52) U.S. Cl. ..... 271/3.14; 271/225; 271/279; 271/298; 271/302; 271/184; 271/198; 271/213; 399/405

(58) Field of Classification Search ..... 271/225, 271/281, 279, 298, 302, 177, 184, 191, 198, 271/199, 213, 3.14, 3.21, 6, 4.06, 4.09; 399/405
See application file for complete search history.

(56) References Cited

FOREIGN PATENT DOCUMENTS

| | | | |
|---|---|---|---|
| JP | 2002-23270 | A | 1/2002 |
| JP | 2002-23279 | A | 1/2002 |

*Primary Examiner* — Michael McCullough
(74) *Attorney, Agent, or Firm* — Knobbe Martens Olson & Bear LLP

(57) ABSTRACT

An image forming apparatus allowing a printing section inside of a casing to print paper and discharging the printed paper from the casing through a discharge port of the casing includes a discharge tray configured such that the position thereof is switchable from a placement position for covering the surface of a feeding belt and receiving the paper discharged from the casing to an exposure position for exposing the surface of the feeding belt, and vice versa, wherein a surface of the discharge tray has a coefficient of friction lower than the surface of the feeding belt.

2 Claims, 7 Drawing Sheets

IMAGE FORMING APPARATUS

CROSS-REFERENCE TO RELATED APPLICATION

This application claims priority to Japanese Patent Application No. 2009-240097 filed on Oct. 19, 2009, the disclosure of which including the specification, the drawings, and the claims is hereby incorporated by reference in its entirety.

BACKGROUND

The present disclosure relates to an image forming apparatus capable of allowing a printing section inside of a casing to print paper and discharging the printed paper from the casing through a discharge port of the casing.

Conventionally, an image forming apparatus is known which allows a printing section inside of a casing to print paper, discharges the printed paper (onto a feeding belt) from the casing through a discharge port of the casing and allows the feeding belt to receive the discharged paper (e.g., refer to Japanese Patent Publication No. 2002-23279). The feeding belt feeds sheets of paper received by the feeding belt to a stacking unit provided on a side face of the casing, and then, the stacking unit assorts the sheets of paper into groups each given a predetermined number of sheets (e.g., according to orders). The stacking unit includes a plurality of circulation-type trays and stacks, on each tray, for example, sheets of paper for each order.

SUMMARY

However, in the image forming apparatus of the prior art, when the feeding belt receives a sheet of paper discharged from the casing, the sheet of paper can be discharged such that a printed surface thereof comes into contact with the surface of the feeding belt. In this case, the printed surface coming into contact with the surface of the feeding belt may rub against the surface of the feeding belt, thereby causing damage to the printed surface and deteriorating the print quality thereof. Specifically, the feeding belt is made of a material such as rubber having a high coefficient of friction so that it can certainly feed the sheet of paper placed thereon to the stacking unit. This makes it easier to damage the printed surface of the sheet of paper when the printed surface rubs against the surface of the feeding belt.

Here, when the feeding belt receives a sheet of paper only one surface of which is printed, the sheet of paper can be discharged such that the surface (the back surface) reverse to the printed surface thereof comes into contact with the surface of the feeding belt. In this case, the printed surface is not supposed to rub against the surface of the feeding belt, thereby preventing a deterioration in the print quality of the printed surface.

However, when the feeding belt receives a sheet of paper both surfaces of which are printed, the sheet of paper is discharged such that one of both printed surfaces thereof comes into contact with the surface of the feeding belt. Hence, the one printed surface may rub against the surface of the feeding belt, thereby deteriorating the print quality of the printed surface.

In view of the foregoing, it is an object of the present invention to provide an image forming apparatus capable of, even if printing both surfaces of a sheet of paper, then preventing any printed surface of the sheet of paper from rubbing against the surface of a feeding belt and thereby the print quality of the printed surfaces from deteriorating.

In order to accomplish the object, an image forming apparatus of the present invention allowing a printing section inside of a casing to print paper and discharging the printed paper from the casing through a discharge port of the casing, includes: a feeding belt configured to receive the paper discharged from the casing, and to feed the received paper; and a discharge tray configured such that the position thereof is switchable from a placement position for covering the surface of the feeding belt and receiving the paper discharged from the casing to an exposure position for exposing the surface of the feeding belt, and vice versa, in which a surface of the discharge tray has a coefficient of friction lower than the surface of the feeding belt.

According to this configuration, the position of the discharge tray is switchable from the placement position to the exposure position, and vice versa. Therefore, the position of the discharge tray is changed to the exposure position when a sheet of paper only one surface of which is printed is discharged from the casing, while the position of the discharge tray is changed to the placement position when a sheet of paper both surfaces of which are printed is discharged from the casing. Hence, the sheet of paper having only one printed surface and discharged from the casing is received by the feeding belt. The sheet of paper having the single printed surface is discharged such that the surface (the back surface) reverse to the printed surface thereof comes into contact with the surface of the feeding belt, thereby preventing the printed surface from being damaged. On the other hand, if the sheet of paper having both printed surfaces and discharged from the casing is received by the feeding belt, either of the face and back printed surfaces may rub against the surface of the feeding belt, thereby deteriorating the print quality of the printed surface subjected to the rubbing. Taking this into account, the position of the discharge tray is changed to the placement position such that the discharge tray can directly receive the sheet of paper having both printed surfaces and discharged from the casing. A surface of the discharge tray has a coefficient of friction lower than the surface of the feeding belt, and hence, even if either of the face and back printed surfaces rubs against the surface of the discharge tray, the printed surface subjected to the rubbing can be prevented from being damaged. This makes it possible to prevent a deterioration in the print quality of both printed surfaces of the sheet of paper.

The feeding belt is capable of feeding the sheet of paper having the single printed surface to a predetermined collection position (e.g., arrangement position of a stacking unit). On the other hand, the feeding belt is incapable of feeding the sheet of paper having both printed surfaces which is placed on the discharge tray, but no serious problem arises because the sheet of paper is collectable from the placement position thereof.

In the above image forming apparatus, it is preferable that the feeding belt is arranged in front of the discharge port in a direction where the paper is discharged and extends perpendicularly to the discharge direction, and when the discharge tray is in the exposure position, the discharge tray is located opposite to the discharge port with respect to the feeding belt in the discharge direction of the paper and turns toward the feeding belt on a pivot axis extending perpendicularly to the discharge direction of the paper at the edge of the discharge tray located in the exposure position on the side of the feeding belt, and thereby, the position of the discharge tray changes to the placement position.

According to this configuration, when the discharge tray is in the exposure position, the discharge tray receives a sheet of paper discharged from the discharge port even if the sheet of paper is long enough for the front edge thereof to go beyond the feeding belt. In addition, the discharge tray can be simply turned and thereby easily brought to the placement position, thereby preventing a deterioration in the print quality of the printed surfaces of a sheet of paper using the simple configuration.

DETAILED DESCRIPTION

An illustrative embodiment of the present invention will be below described in detail with reference to the drawings. The following description of the illustrative embodiment is essentially provided only for an illustration, and hence, the present invention, the one applied thereto or the use thereof is not supposed to be limited.

Figure 1:
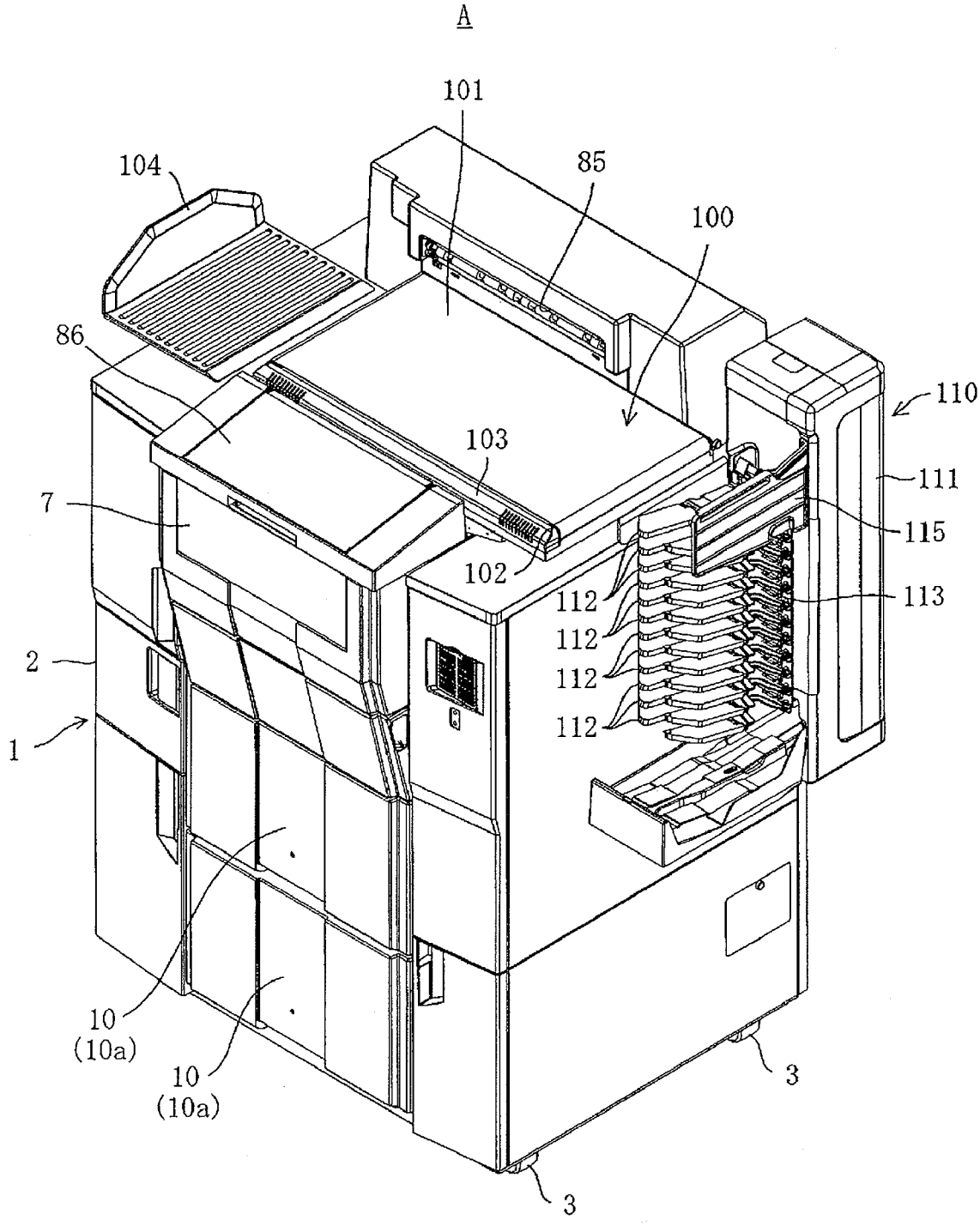
FIG. 1 is a perspective view showing an external appearance of an ink jet printer as an image forming apparatus according to an illustrative embodiment of the present invention.
Figure 2:
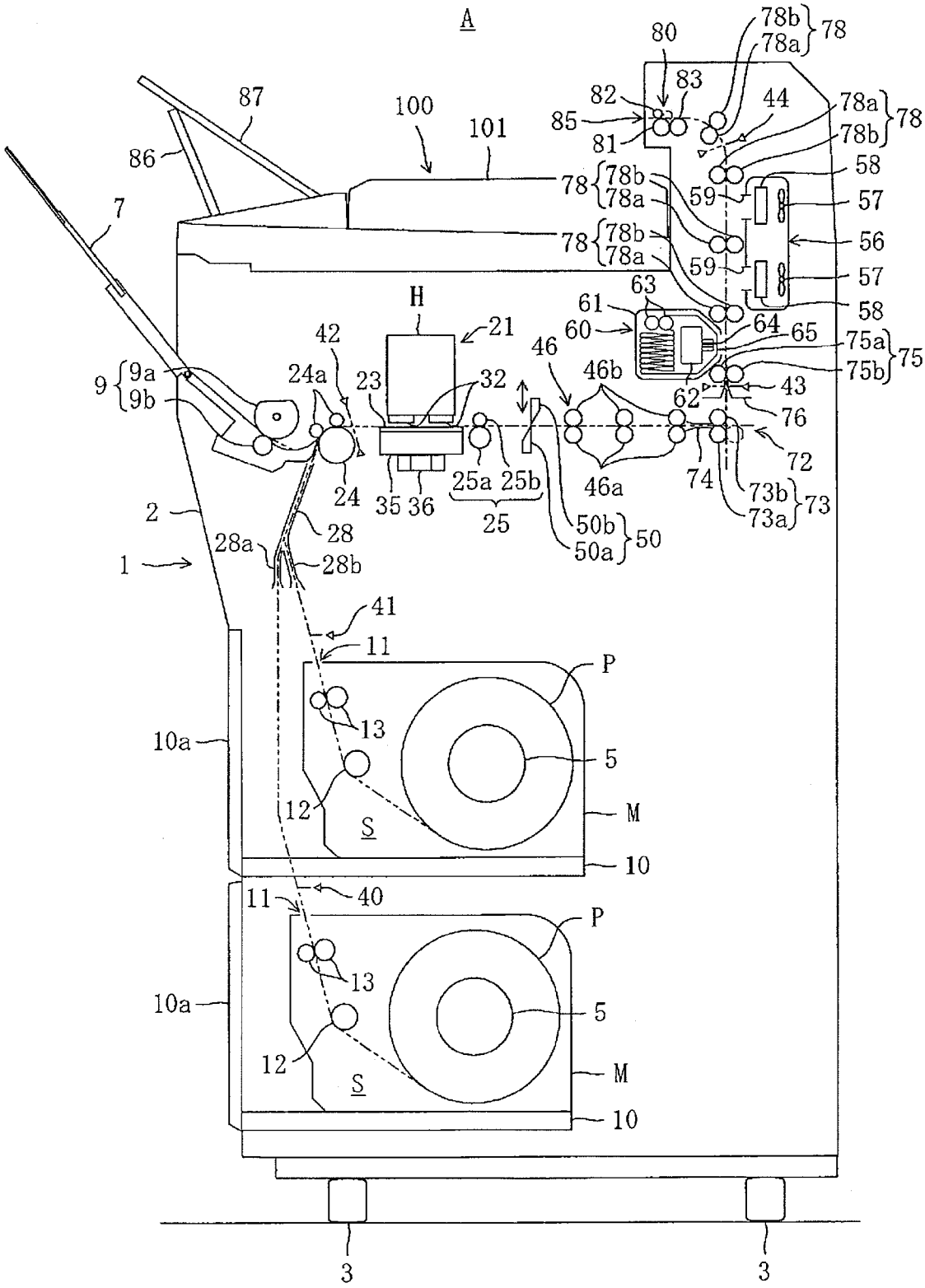
FIG. 2 is a schematic side view showing an internal configuration of the ink jet printer.

FIG. 1 is a perspective view showing an external appearance of an ink jet printer A as an image forming apparatus according to the illustrative embodiment. FIG. 2 is a schematic side view showing an internal configuration of the ink jet printer A.

As shown in FIGS. 1 and 2, the ink jet printer A is employed for a photographic print system and for example, prints (forms an image on) paper P on the basis of image data transmitted through a communication cable from an acceptance block (not shown) acquiring image data and executing a required correction processing or the like.

The ink jet printer A includes a printer body section 1 formed by a casing 2 and casters 3 provided in the bottom surface thereof. The casing 2 of the printer body section 1 houses two magazines M vertically arranged in the lower part thereof, and a roll of the long paper P is storable in each magazine M.

In the illustrative embodiment, the side (the left side of FIG. 2) of the printer body section 1 on which a manual tray 7 (described later) lies corresponds to the printer front side, while the opposite side (the right side of FIG. 2) thereof corresponds to the printer rear side. In FIG. 2, the right-and-left directions correspond to the printer front-and-rear directions, and the directions perpendicular to the paper surface of FIG. 2 correspond to the printer right-and-left directions and are identical with the width directions of the paper P fed inside of the casing 2 of the printer body section 1.

The magazine M is a portable and substantially-closed box-shaped container and the long paper P rolled around a roll core 5 is stored in a storage chamber S inside of the magazine M. The upper face of the magazine M is formed at an edge part thereof on the printer front side with an opening portion 11 for drawing the paper P stored in the magazine M from the magazine M. The opening portion 11 has a substantially rectangular shape extending in the same directions (the width directions of the paper P) as the roll core 5.

The magazine M includes a magazine roller 12 for sending the paper P out of the storage chamber S through the opening portion 11. The paper P sent out using the magazine roller 12 is delivered to a supply roller 24 (described later).

The magazine M also includes a holding roller pair 13 between the opening portion 11 and the magazine roller 12 which holds the paper P drawn from the roll core 5 inside of the magazine M. The holding roller pair 13 holds a front-edge part of the paper P between in the magazine M, thereby restraining the front-edge part of the paper P from moving freely inside of the magazine M. This is helpful in preventing the rolled paper P from coming loose or a surface to be printed of the paper P from rubbing against the inner bottom surface of the magazine M.

Figure 3:
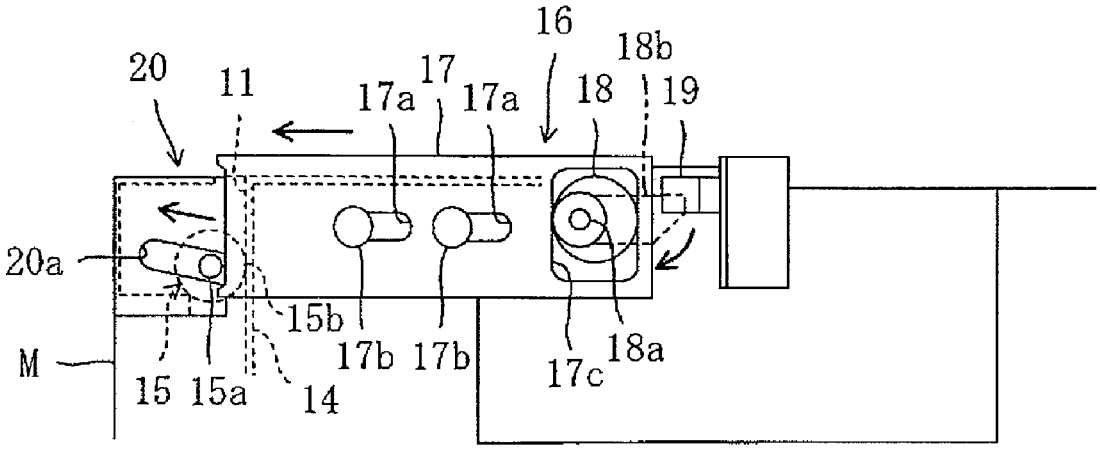
FIG. 3 is a side view showing a main part of a magazine with an opening portion of the magazine kept closed.

FIG. 3 is a side view showing a main part of the magazine M with the opening portion 11 of the magazine M kept closed. As shown in FIG. 3, the opening portion 11 of the magazine M is provided with an opening-and-closing shutter mechanism 20 opening and closing the opening portion 11. The opening-and-closing shutter mechanism 20 includes: a guide plate 14 for guiding the paper P drawn from the roll core 5 to the opening portion 11; a shutter roller 15 switching from a state where the shutter roller 15 is pressed against the guide plate 14 to a state where it is not pressed against the guide plate 14, and vice versa; and a cam mechanism 16 driving the shutter roller 15.

The shutter roller 15 opens or closes the opening portion 1 to permit or shut off a flow of air inside and outside of the magazine M and includes a shaft portion 15*a* extending along the opening portion 11 of the magazine M and a roller portion 15*b* arranged in the peripheral part of the shaft portion 15*a* and pressed against the guide plate 14. The shutter roller 15 is supported on an elongated hole 20*a* formed near the opening portion 11 in the side wall of the magazine M on each side in the printer right-and-left directions and is slidable via the shaft portion 15*a*. The shaft portion 15*a* of the shutter roller 15 is constantly forced toward the guide plate 14 by a forcing spring (not shown). Therefore, the peripheral surface of the roller portion 15*b* is pressed against the guide plate 14 to close the opening portion 11, and the shaft portion 15*a* is substantially in contact with the front-edge part of a slide plate 17 forming a part of the cam mechanism 16 (practically, there is a slight gap between them).

The cam mechanism 16 includes the slide plate 17 and an eccentric cam 18 driven by a cam drive motor (not shown). The slide plate 17 is formed with two elongated holes 17*a* extending in the printer front-and-rear directions. The slide plate 17 is provided with two guide shafts 17*b* each inserted through the corresponding elongated hole 17*a*. The guide shafts 17*b* protrude outward from the side wall of the magazine M on each side in the printer right-and-left directions and support the slide plate 17, thereby enabling the slide plate 17 to slide in the printer front-and-rear directions with supported on the guide shafts 17*b*.

The slide plate 17 is formed at an end part thereof on the printer rear side with a substantially-rectangular cam hole 17*c*, and the inner circumferential surface of the cam hole 17*c* is a contact surface coming into contact with the cam surface of the eccentric cam 18. The eccentric cam 18 is eccentrically attached to an output shaft 18*a* of the cam drive motor. The output shaft 18*a* of the cam drive motor is provided with a detection piece 18*b*, and thereby, a detection sensor 19 attached to the side wall of the magazine Mon each side in the printer right-and-left directions detects a reference rotational position of the cam drive motor.

Figure 4:
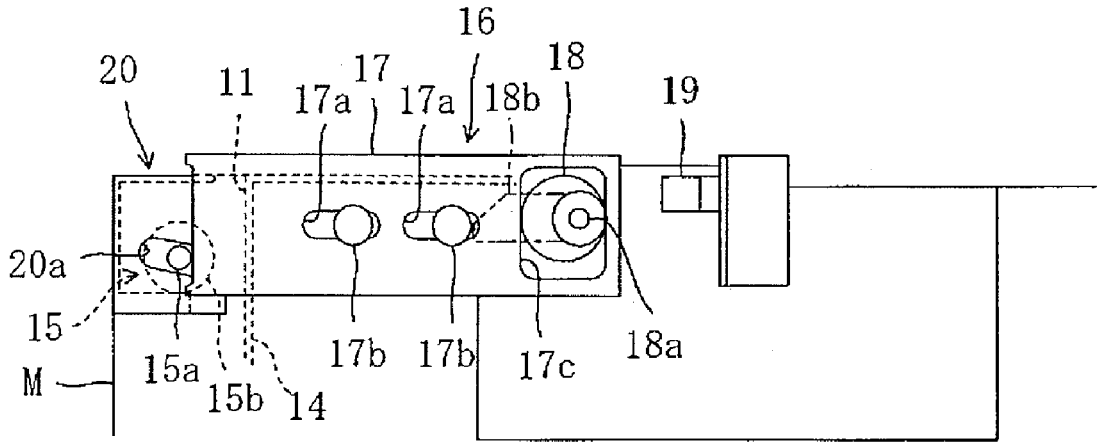
FIG. 4 is a side view showing the main part of the magazine of FIG. 3 with the opening portion kept open.

Next, an operation of the above opening-and-closing shutter mechanism 20 will be specifically described. First, in the state (where the opening portion 11 is closed) shown in FIG. 3, the eccentric part of the eccentric cam 18 is located on the printer rear side with respect to the output shaft 18*a* of the cam drive motor. If the eccentric cam 18 rotates clockwise in FIG. 3, the eccentric part of the eccentric cam 18 is located on the printer front side with respect to the output shaft 18*a* of the cam drive motor (see FIG. 4). At this time, the eccentric cam 18 presses the cam hole 17*c* of the slide plate 17 toward the printer front side, and thereby, the slide plate 17 moves along the guide shafts 17*b* toward the printer front side.

As a result, the shaft portion 15*a* of the shutter roller 15 is pressed by the front-edge part of the slide plate 17 and moves toward the printer front side against the force of the forcing spring. Hence, the roller portion 15*b* of the shutter roller 15 moves toward the printer front side to form a gap between the roller portion 15*b* and the guide plate 14 and open the opening portion 11.

Only when the ink jet printer A is in operation, the eccentric cam 18 of the opening-and-closing shutter mechanism 20 rotates to move the shutter roller 15, and thereby, the opening portion 11 is forcedly opened. Therefore, when the ink jet printer A is not in operation, the opening portion 11 of the magazine M is not supposed to be left open for a long time, thereby preventing air inside of the magazine M from being dried and protecting the paper P inside of the magazine M against a crack or the like.

As shown in FIG. 2, the magazine M is placed on a slide table 10 provided in the casing 2 and slidable in the printer front-and-rear directions. The slide table 10 is slidable in the printer front-and-rear directions on linear guides (not shown) or the like provided on both sides in the printer right-and-left directions inside of the casing 2 and extending in the printer front-and-rear directions. The slide table 10 is slid to set the magazine M into and out of the casing 2. The face of the slide table 10 on the printer front side forms a part of the casing 2 and is covered with a door member 10*a* freely opened and closed, and the door member 10*a* is opened to replace the paper P. The printer front-side part of the slide table 10 for the upper magazine M has a cutout (not shown) for leading in the paper P drawn from the lower magazine M.

In an upper part (above the upper magazine M) inside of the casing 2, a printing section 21 is provided which prints (forms an image on) the paper P drawn from the storage chamber S of the magazine M on the basis of image data.

A guide member 28 for leading the paper P to the printing section 21 is provided between the magazine M and the printing section 21. The guide member 28 prevents the front-edge part of the paper P from slipping out of place when it passes through a feeding path and goes toward the supply roller 24. The guide member 28 is provided at the upstream end thereof in the feeding direction of the paper P with two first and second branch paths 28*a* and 28*b*. The paper P drawn from the lower magazine M is inserted through the first branch path 28*a* and the paper P drawn from the upper magazine M is inserted through the second branch path 28*b*. Therefore, the paper P stored in each of the vertically-arranged magazines M passes through the separate feeding path, finally joins together and reaches the supply roller 24.

A first sensor 40 and a second sensor 42 are provided between the guide member 28 and the magazines M respectively, and the sensors 40 and 42 are of a reflection type and detect the front edge of the paper P being drawn from the magazine M.

The manual tray 7 for an operator manually supplying paper (a sheet of paper) cut off in advance and having a predetermined size is provided in an upper part on the printer front side of the printer body section 1. As shown in FIG. 1, the manual tray 7 is folded into the casing 2 when it is not used.

A manual roller pair 9 is provided on the printer rear side from the manual tray 7. The manual roller pair 9 is formed by a driving roller 9*a* coming into contact with the surface (the upper surface) of a sheet of paper manually supplied to the manual tray 7 on which the printing section 21 prints an image, and a driven roller 9*b* coming into contact with the reverse surface (the lower surface) thereof. A manual-roller drive motor (not shown) drives the driving roller 9*a* to rotate the manual roller pair 9 and send the sheet of paper manually supplied to the manual tray 7 toward the supply roller 24.

The ink jet printer A of the illustrative embodiment is configured to print both the paper P stored in the storage chamber S of the magazine M and the manually-supplied sheet of paper and give one and the same processing to the paper after supplied to the supply roller 24. Therefore, the case where the paper P stored in the magazine M is fed and printed will basically be below described. Here, as described later, there is a case where the sheet of paper P (cut off by a cutter 50 (described later) and having a predetermined size) having a single printed surface is manually supplied to the manual tray 7 (to print both surfaces thereof). Hence, the manually-supplied sheet of paper will also be below called the paper P.

As shown in FIG. 2, the paper P supplied to the supply roller 24 is sent to the printing section 21 by the supply roller 24. Specifically, the paper P is held between the supply roller 24 and two pressure rollers 24*a* facing the supply roller 24, then the supply roller 24 is rotated clockwise in FIG. 2 by a supply-roller drive motor (not shown) and thereby the paper P is fed to the printing section 21.

The supply roller 24 is rotatable in both the forward and reverse directions by the supply-roller drive motor, and the forward rotation is for drawing the paper P from the storage chamber S of the magazine M and feeding it to the printing section 21 while the reverse rotation is for returning the drawn paper P into the storage chamber S. This makes it possible, for example, to stop halfway printing the paper P drawn from the magazine M on one side to the printing section 21 and return the paper P on the feeding path into the magazine M, and instead, supply the paper P manually supplied to the manual tray 7 or the paper P inside of the magazine M on the other side to the printing section 21 and print there. In addition, if the paper P drawn to the printing section 21 from the magazine M needs to be replaced with new paper, the drawn paper P can be returned into the magazine M.

The printing section 21 is arranged downstream from the supply roller 24 in the feeding direction of the paper P and includes a print head H printing a surface to be printed of the paper P and a platen 23 supporting the paper P fed by the supply roller 24. The upstream side and the downstream side in the feeding direction of the paper P will be below called simply as the upstream side and the downstream side respectively.

On the downstream side with respect to the print head H, a pressure-type downstream roller pair 25 is provided which is formed by a driving roller 25*a* arranged under the horizontally-extending feeding path and a driven roller 25*b* arranged thereover. The driving roller 25*a* is driven by a downstream-roller drive motor (not shown).

The supply roller 24 is provided on the downstream side with a third sensor 42 (formed by a light-injection portion and a light-reception portion) detecting the front edge of the paper P sent from the supply roller 24. If it is judged from a detection result of the front edge of the paper P by the third sensor 42 that the supply roller 24 has fed the paper P by a certain distance from there and a printing-start part of the paper P has reached under the print head H, then the paper P starts to be printed. Further, if it is judged from a detection result of the front edge of the paper P by the third sensor 42 that the supply roller 24 has fed the paper P by a certain distance from there and the front edge of the paper P has reached the downstream roller pair 25, then the supply roller 24 changes from a pressing state to a non-pressing state and the downstream roller pair 25 changes from a non-pressing state to a pressing state. This time, the downstream roller pair 25 feeds the paper P.

Figure 5:
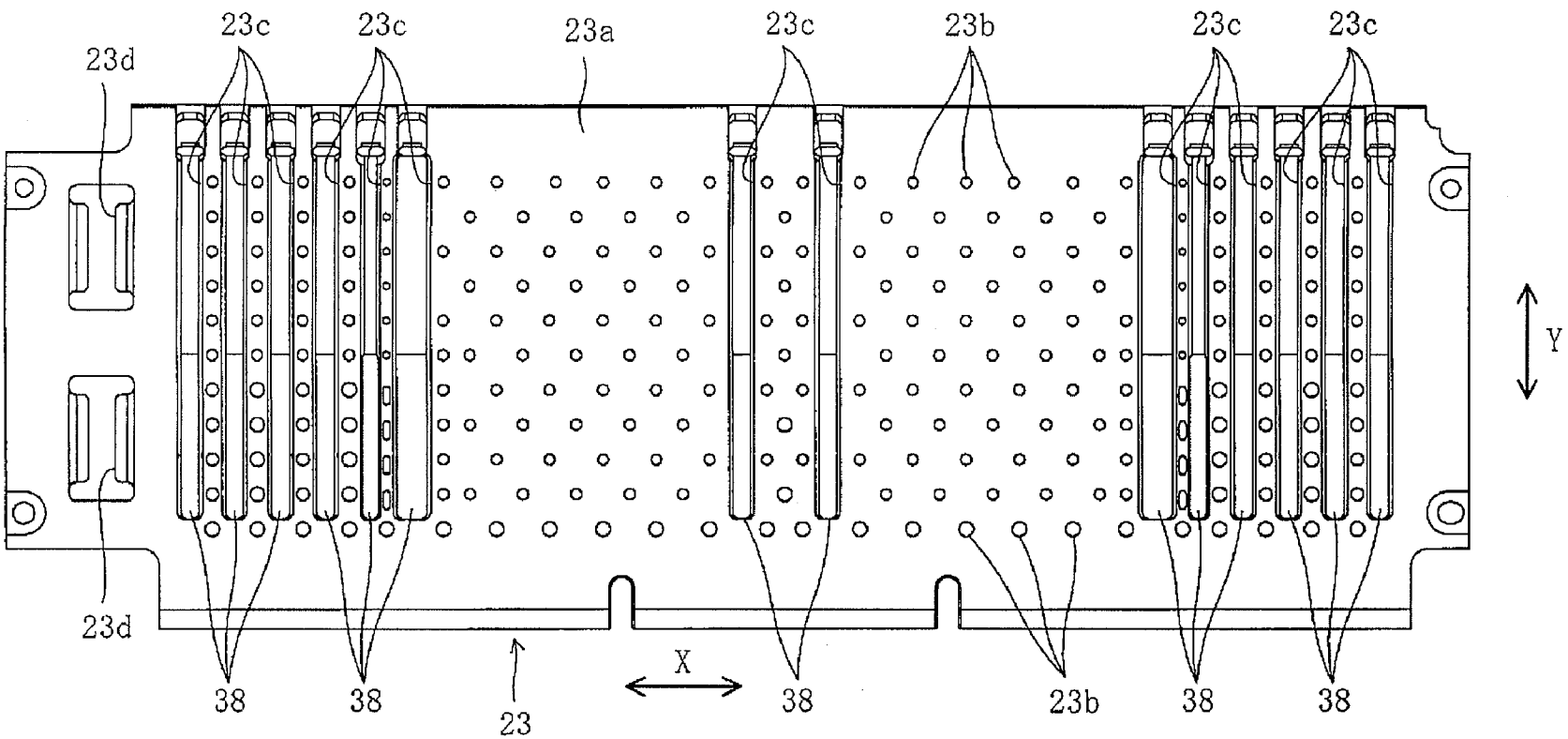
FIG. 5 is a plan view showing a configuration of a platen in a printing section.
Figure 6:
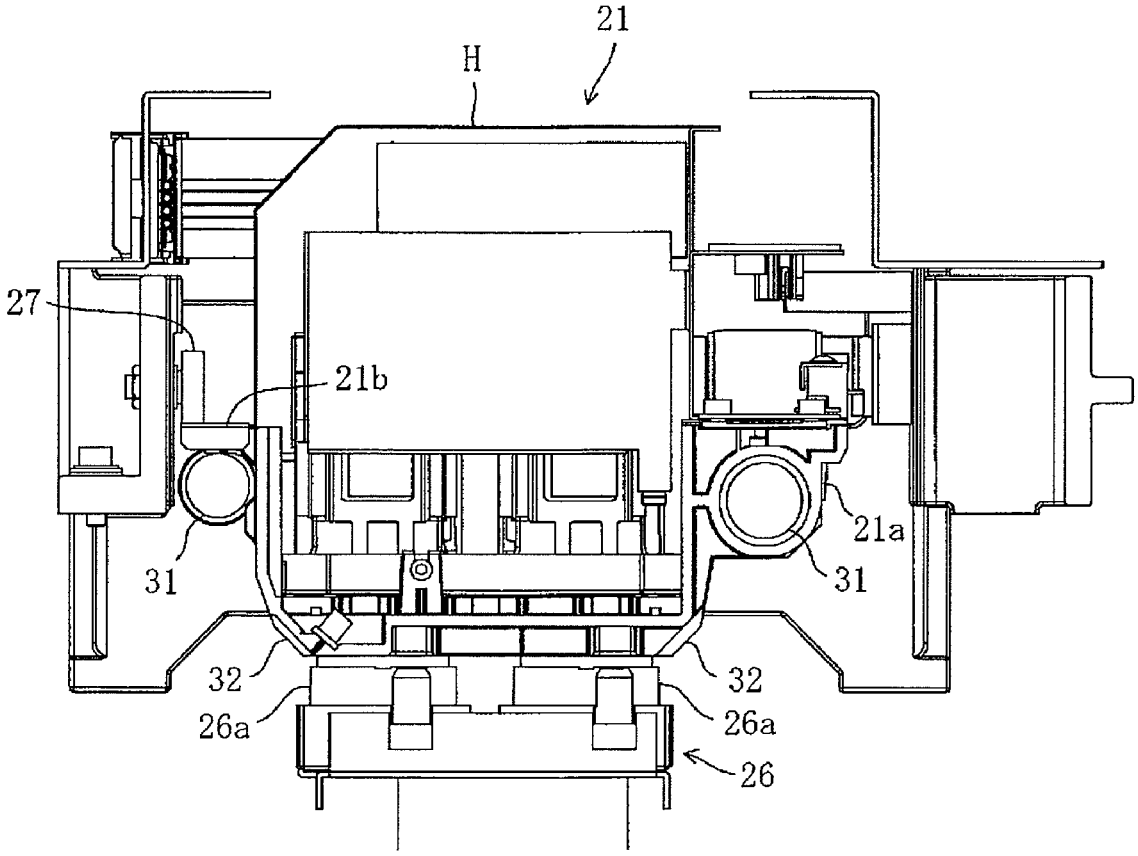
FIG. 6 is a side view showing a configuration of the printing section and a cap section.

As shown in FIGS. 5 and 6, the print head H is movable along two guide rails 31 extending in main-scanning directions X identical to the width directions (the printer right-and-left directions) of the paper P over the paper P supported on the platen 23. The print head H includes two head units 32, 32 arranged side by side in sub-scanning directions Y perpendicular to the main-scanning directions X and identical to the movement directions (the printer front-and-rear directions) of the paper. The two head units 32, 32 are each provided at a lower face thereof with many ink discharge nozzles (not shown) discharging inks of a plurality of colors downward and printing a predetermined image on a surface to be printed of the paper P. In the illustrative embodiment, the two head units 32 are arranged side by side in the sub-scanning directions Y, but the number of head units is not limited to two and hence may be one, or three or more.

Both head units 32 have the same formation and each include a plurality of nozzle arrays arranged in the main-scanning directions X and discharging the ink of each color. In each nozzle array, the ink discharge nozzles are arranged in line in the sub-scanning directions Y, thereby enabling each single head unit 32 to print a color image. The paper P is fed intermittently (stepwise) by a fixed unit feeding distance in the sub-scanning directions Y by the supply roller 24 or the downstream roller pair 25. When the paper P comes to each halt while being intermittently fed, the print head H makes one scan (one forward motion or one backward motion) in the main-scanning directions X. At the time of each scan, the ink discharge nozzles for each color of each head unit 32 discharge inks simultaneously onto the upper surface of the paper P at each position in the main-scanning directions X. In other words, the paper P is fed by the unit feeding distance after the print head H makes one scan, and thereafter, the print head H makes another scan. Then, this operation is repeated to print a desired image on the upper surface of the paper P, and thereby, the upper surface of the paper P located in the printing section 21 becomes a printed surface.

Here, the print head H of the illustrative embodiment discharges an ink in an ordinary piezoelectric method. In this method, the volume inside of a pressure chamber filled with an ink is varied by a piezoelectric element, and thereby, the ink is discharged from an ink discharge nozzle communicating with the pressure chamber.

The platen 23 is a plate-shaped member and the upper surface thereof is a support surface 23*a* supporting the paper P. The platen 23 is formed with many suction holes 23*b* penetrating in the thickness directions (the up-and-down directions) thereof and opening in the support surface 23*a*. Under the platen 23, a case body 35 (see FIG. 2) forming a space together with the platen 23 is provided, and a suction device 36 (see FIG. 2) including a fan or the like is provided under the case body 35. The suction holes 23*b* communicates with the space inside of the case body 35 and this space communicates with the suction port of the suction device 36. The operation of the suction device 36 generates a negative pressure, through the suction holes 23*b*, on the support surface 23*a* of the platen 23, and thereby, the paper P is absorbed and held onto the support surface 23*a* of the platen 23. This makes it possible to flatten the paper P securely when it is printed and hence improve the print quality thereof.

The support surface 23*a* of the platen 23 is formed with concave portions 23*c* extending in the sub-scanning directions Y and each having an ink absorber 38 stored therein. In no-margin printing where an image is printed over the whole surface of the paper P, even if a part of ink discharged from the print head H (the head units 32) runs out of an edge of the paper P on the support surface 23*a* in the width directions, then the ink absorber 38 prevents the support surface 23*a* of the platen 23 from being dirtied with the part of ink. Hence, the concave portions 23*c* are arranged in the positions corresponding to the edges of the paper P on the support surface 23*a* in the width directions and the position corresponding to the print head H in the sub-scanning directions Y such that the concave portions 23*c* extend along those edges (i.e., in the sub-scanning directions Y). In the example of FIG. 5, the fourteen concave portions 23*c* in total are arranged.

In an edge part on one side (out of a printing range) of the platen 23 in the main-scanning directions X, a flashing hole 23*d* is formed at each position corresponding to the head units 32, 32 in the sub-scanning directions Y. In order to prevent ink thickening, the flashing hole 23*d* receives a small quantity of ink discharged from the nozzle of the print head H when printing starts to be conducted.

In a position out of the printing range of the print head H in the main-scanning directions X (sideward on the one side of the platen 23 in the main-scanning directions X), a standby position for holding the print head H on standby when it is not printing, and a cap portion 26 is provided in the standby position (see FIG. 6). When the print head H is not used, in order to prevent ink thickening, the cap portion 26 comes into close contact with the head units 32, 32 of the print head H. The cap portion 26 includes two suction caps 26*a* corresponding to the head units 32, 32 and placed in array in the sub-scanning directions Y. The cap portion 26 moves up and down between a position where it is in close contact with the bottom surface of the print head H and a position where it is separate from the bottom surface of the print head H.

On the printer rear side (the right side in FIG. 6) of the print head H, a bearing holder 21*a* for inserting the rear guide rail 31 through is provided, and thereby, the print head H is supported turnably on the rear guide rail 31. On the other hand, a head guide 21*b* protruding to the printer front side is provided on the printer front side (the left side in FIG. 6) of the print head H. The head guide 21*b* is placed slidably on the front guide rail 31 and supports the print head H together with the bearing holder 21*a* such that the print head H is kept horizontal. If the paper P is stuck between the print head H and the platen 23, then the operator can raise the front part of the print head H and turn the print head H about the rear guide rail 31, thereby making the maintenance thereof easier.

In the standby position of the print head H, a sandwiching roller 27 is provided above the front guide rail 31. The print head H moves to the standby position, and thereby, the head guide 21*b* of the print head H is held between the sandwiching roller 27 and the front guide rail 31. Therefore, in the standby position, the print head H is prevented from being forced up when the cap portion 26 moves up and comes into close contact with the bottom surface of the print head H. In the close-contact position, the cap portion 26 forms a negative-pressure space between the cap portion 26 and the bottom surface of the print head H and thereby sucks ink from the nozzle thereof. The sucked ink is collected in a waste liquid tank (not shown).

Four ink cartridges (not shown) each containing an ink different in hue are housed detachably in a lower part (on the right side if seen from the printer front side) inside of the casing 2. The ink cartridges are attached and detached to replace a cartridge now in use or a used cartridge with a new one. The ink cartridges contain inks of yellow (Y), magenta (M), cyan (C) and black (K) respectively.

As shown in FIG. 2, the cutter 50 is provided on the printer rear side (downstream from the printing section 21) with respect to the downstream roller pair 25. The cutter 50 cuts the paper P after printed such that the cut-off sheet has a predetermined size (however, the paper P manually supplied to the manual tray 7 is not subjected to the cutoff), or cuts off blanks in a front-edge part and a rear-edge part of the paper P in no-margin printing.

The cutter 50 is formed by a fixed blade 50*a* arranged under the feeding path of the paper P and a moving blade 50*b* arranged over the feeding path of the paper P and moved vertically with respect to the fixed blade 50*a* by a cutter drive motor (not shown). The moving blade 50*b* moves from above to below the paper P to cut the paper P, and a piece of waste paper produced in the cutoff falls into a trash can (not shown) arranged in the lower part of the casing 2 and is stored therein.

On the printer rear side (downstream) from the cutter 50, three pressure-type feeding roller pairs 46 are provided which hold the sheet of paper P cut off by the cutter 50 between and feed it further to the printer rear side.

In the three feeding roller pairs 46, driving rollers 46*a* arranged under the feeding path are driven by a single feeding-roller motor (not shown), and the rotational speed thereof or the speed of the paper P fed by the feeding roller pairs 46 is variable. Furthermore, the state of each of driven rollers 46*b* arranged over the feeding path is switchable from a state where it is pressed against the corresponding driving roller 46*a* to a state where it is not pressed against the corresponding driving roller 46*a*, and vice versa. The feeding roller pairs 46 come into the non-pressing state before holding the front edge of the sheet of paper P cut off by the cutter 50 between. This makes it possible to prevent the front edge of the paper P from hitting and bending against the feeding roller pairs 46 in the pressing state or another kind of trouble. Here, all the driven rollers 46*b* of the three feeding roller pairs 46 switch simultaneously to the non-pressing state.

The sheet of paper P fed from the feeding roller pairs 46 is fed to a switchback section 72. The switchback section 72 switches the paper P back as described later, and thereby, the paper P is discharged, with the printed surface thereof up, from a discharge port 85 (described later) onto a feeding belt 101 of a conveyor unit 100 (described later).

Figure 7:
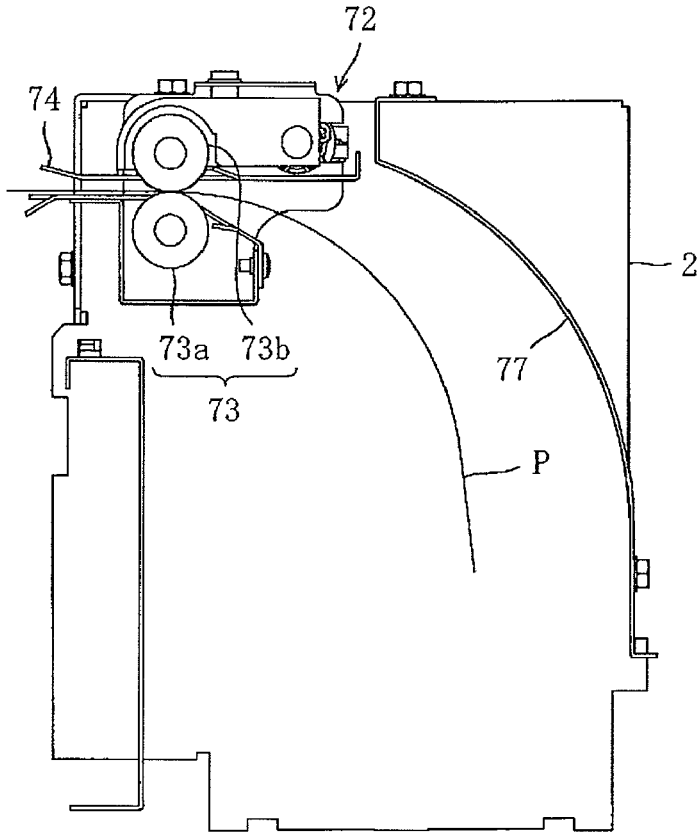
FIG. 7 is a schematic view showing a switchback roller pair of a switchback section receiving paper fed from a feeding roller pair.

As shown in FIGS. 2 and 7, the switchback section 72 includes a pressure-type switchback roller pair 73 formed by a lower driving roller 73*a* and an upper driven roller 73*b*, a pair of first guide members 74 sandwiching the feeding path between on the upstream side from the switchback roller pair 73 and guiding the paper P fed from the feeding roller pairs 46 to the switchback roller pair 73, a pressure-type supply roller pair 75 supplying the switched-back paper P to a back-surface printing unit 60 (described later), and a pair of second guide members 76 which is arranged between the switchback roller pair 73 and the supply roller pair 75, sandwiches the feeding path between and leads the switched-back paper P to the supply roller pair 75.

The driving roller 73*a* of the switchback roller pair 73 is driven by a switchback-roller drive motor (not shown) and thereby is rotatable in the forward direction such that the driving roller 73*a* together the driven roller 73*b* feeds the paper P held between both rollers to the printer rear side and in the reverse direction such that the driving roller 73*a* together the driven roller 73*b* feeds the paper P to the printer front side.

Figure 8:
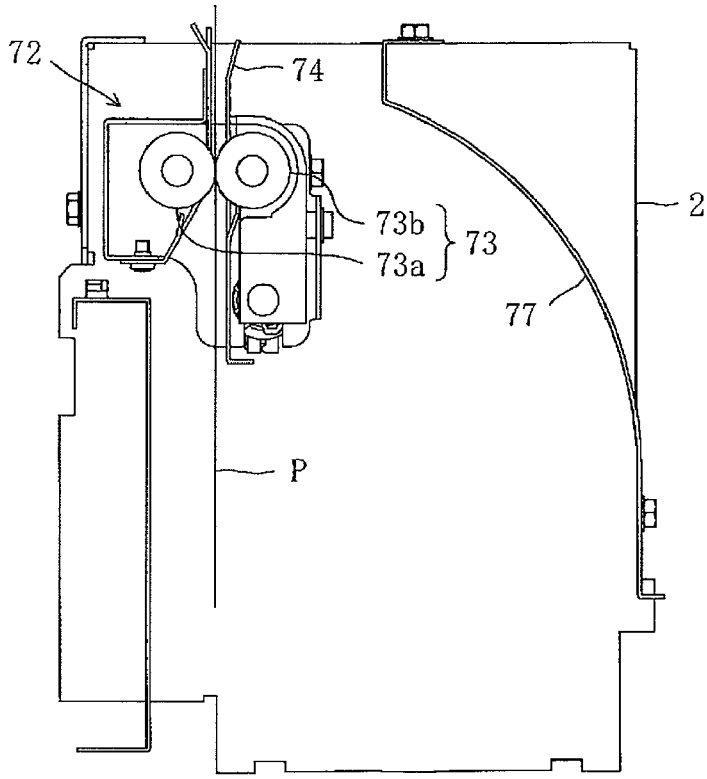
FIG. 8 is a schematic view showing a driven roller of the switchback roller pair of FIG. 7 being brought to a second position.

The switchback roller pair 73 and the first guide members 74 are turnable in one united body about the rotational axis of the driving roller 73*a* of the switchback roller pair 73 by a turning motor (not shown). This makes it possible to switch the relative position of the driven roller 73*b* to the driving roller 73*a* of the switchback roller pair 73 from a first position substantially right over the driving roller 73*a* for feeding the paper P to the printer rear side as shown in FIG. 7 to a second position on the printer rear side of the driving roller 73*a* for feeding the paper P from the rear-edge side of the paper P and supplying the paper P to the back-surface printing unit 60 as shown in FIG. 8, and vice versa.

Here, a description will be given about a switchback operation for switching back the sheet of paper P fed from the feeding roller pairs 46. When the switchback roller pair 73 receives the paper P fed from the feeding roller pairs 46, the driving roller 73*a* makes a forward rotation and the driven roller 73*b* is in the first position. Then, the switchback roller pair 73 feeds the paper P to the printer rear side by a certain distance, and when the rear edge of the paper P reaches the first guide members 74 (see FIG. 7), the driving roller 73*a* stops rotating in the forward direction.

At this time, a front-edge part of the paper P is bent and deflected downward by the weight of the paper P itself. If the paper P is not deflected by the weight because of the great flexural stiffness thereof, the front edge of the paper P comes into contact with a bent guide plate 77 provided downstream from the switchback roller pair 73 and thereby is bent downward along the bent guide plate 77.

Next, the switchback roller pair 73 and the first guide members 74 are turned clockwise in FIG. 7 to switch the position of the driven roller 73*b* from the first position to the second position. Therefore, the rear-edge side (on the printer rear side) of the paper P is raised and the front-edge side of the paper P is hung by the weight of the paper P itself, and hence, the paper P is vertically extended.

Thereafter, the driving roller 73*a* rotates in the reverse direction and feeds the paper P from the rear-edge side of the paper P toward the supply roller pair 75 arranged above it. In this manner, the paper P is switched back, and then, the switched-back paper P passes through the first guide members 74 and the second guide members 76 and reaches the supply roller pair 75.

In the illustrative embodiment, the driven roller 73*b* turns around the driving roller 73*a* of the switchback roller pair 73, thereby switching the position of the switchback roller pair 73 from the first position to the second position, and vice versa. However, the present invention is not limited to this, and for example, both the driving roller 73*a* and the driven roller 73*b* may be movable to switch the position of the whole switchback roller pair 73 from the first position to the second position, and vice versa.

Furthermore, in the illustrative embodiment, the switchback roller pair 73 is formed by the driving roller 73*a* feeding the paper P and the driven roller 73*b* driven and rotated by the driving roller 73*a*. However, both rollers constituting the switchback roller pair 73 may be driving rollers.

As shown in FIG. 2, upstream from the supply roller pair 75, a fourth sensor 43 (formed by a light-injection portion and a light-reception portion) is provided which detects the front edge of the paper P sent from the switchback roller pair 73.

The supply roller pair 75 is formed by a driving roller 75*a* driven by a supply-roller drive motor (not shown) and a driven roller 75*b* pressed against the driving roller 75*a*. The state of the driven roller 75*b* is switchable to a state where it is not pressed against the driving roller 75*a*.

On the downstream side with respect to the supply roller pair 75, the back-surface printing unit 60 is provided which prints a serial number on the back surface (reverse to the printed surface) of the paper P. Downstream from the back-surface printing unit 60, four pressure-type downstream roller pairs 78 are provided which are each formed by a driving roller 78*a* arranged on the printer front side of the vertical feeding path and a driven roller 78*b* arranged on the printer rear side thereof. All the driving rollers 78*a* are driven by a single motor (not shown).

The back-surface printing unit 60 is a dot-impact printing unit and includes an ink ribbon cassette 61 housing an ink ribbon 65 and a printing head 62 pressing the ink ribbon 65.

The ink ribbon 65 housed in the ink ribbon cassette 61 carries ink, is folded in the ink ribbon cassette 61 and is held between the rollers of a ribbon-feeding roller pair 63 inside of the ink ribbon cassette 61. The ink ribbon cassette 61 is formed at the front end thereof with an opening portion for the passage of the ink ribbon 65. The ink ribbon 65 is looped and is forwarded with held between the rollers of the ribbon-feeding roller pair 63, and a part thereof is exposed through the opening portion to the outside thereof.

The printing head 62 is provided with a plurality of needle pins 64 each making a reciprocating motion in the axial direction thereof. The printing head 62 allows the needle pins 64 to press the part of the ink ribbon 65 exposed through the opening portion. The ink ribbon 65 pressed by the needle pins 64 is pressed onto the back surface of the paper P and the ink carried thereby is transferred thereon to print the back surface of the paper P. The back-surface printing unit 60 prints the paper P only one surface of which is supposed to be printed, and hence, it does not print the paper P having both surfaces already printed and the paper P having one surface already printed and the other surface supposed to be printed.

A drying unit 56 is provided downstream from the back-surface printing unit 60 (on the side opposite to the back-surface printing unit 60 (on the printed-surface side) with respect to the feeding path). The drying unit 56 blows dry air onto the printed surface of the paper P to dry the ink which has adhered to the printed surface of the paper P in the printing section 21. The drying unit 56 includes plural suction fans 57 sucking air into the drying unit 56, plural heaters 58 heating air sucked by the suction fan 57, and plural blowoff nozzle portions 59 opening on the printer front side of the drying unit 56 and blowing air heated by the heater 58 as the dry air onto the printed surface of the paper P. The suction fan 57, the heater 58 and the blowoff nozzle portion 59 are arranged vertically in two tiers.

Here, the degree to which the drying unit 56 dries the ink varies according to ambient conditions (such as temperature and humidity) where the ink jet printer A is installed. Taking this into account, the rotational speed of the downstream roller pairs 78 is designed to be variable, thereby making the feeding speed of the paper P variable. A fifth sensor 44 (formed by a light-injection portion and a light-reception portion) detecting the front edge of the paper P is provided downstream from the drying unit 56.

The downstream roller pairs 78 feed the paper P dried by the drying unit 56 to a discharge roller pair 80. The discharge roller pair 80 discharges the printed paper P from the discharge port 85 onto the feeding belt 101 of the conveyor unit 100. The feeding path extends horizontally at the discharge roller pair 80 and nearby.

The paper P is curly because it was kept rolled inside of the magazine M, and hence, the paper P needs to undergo de-curling and thereby go out of curl. The de-curling is conducted by the discharge roller pair 80. Specifically, the discharge roller pair 80 includes a feeding roller 81 arranged under the feeding path and feeding the paper P, and a de-curling roller 82 arranged over the feeding path and holding the paper P between the de-curling roller 82 and the feeding roller 81. The feeding roller 81 is provided on the upstream side thereof with a free roller 83 rotated along with the movement of the paper P while being fed thereon.

The relative position of the de-curling roller 82 to the feeding roller 81 is switchable from a feeding position (substantially right over the feeding roller 81) where the de-curling roller 82 feeds the paper P without de-curling it to a de-curling position (between the feeding roller 81 and the free roller 83) up to which the de-curling roller 82 moves clockwise in FIG. 2 along the peripheral surface of the feeding roller 81 from the feeding position and where the de-curling roller 82 feeds the paper P while de-curling it, and vice versa. In the de-curling position, the de-curling roller 82 de-curls and feeds the paper P with curled in the direction opposite to the curl direction thereof. In the case of the paper P manually supplied to the manual tray 7, the de-curling roller 82 is located in the feeding position and is not supposed to de-curl the paper P.

The feeding roller 81 sends the paper P to the printer front side and discharges it from the casing 2 through the discharge port 85 formed in the casing 2. As shown in FIG. 1, the feeding belt 101 of the conveyor unit 100 is arranged on the printer front side of the discharge port 85 (the front side in the discharge direction of the paper P with respect to the discharge port 85) in the upper face of the casing 2. The feeding belt 101 receives the paper P discharged through the discharge port 85 from the casing 2 and feeds the received paper P in the printer right-and-left directions. The feeding belt 101 extends in the printer right-and-left directions (the directions perpendicular to the discharge direction of the paper P).

The conveyor unit 100 includes the feeding belt 101, a driving roller 102 driving the feeding belt 101 and a feeding body portion 103 supporting the driving roller 102 such that it is rotatable. The driving roller 102 is rotatable in the forward direction such that the paper P on the feeding belt 101 is fed in the one direction (toward the side where a stacking unit 110 is provided (toward the right side if seen from the printer front side)) of the printer right-and-left directions and in the reverse direction such that the paper P on the feeding belt 101 is fed in the other direction (toward the side where a large-sized tray 104 is provided (toward the left side if seen from the printer front side)) of the printer right-and-left directions.

The part of the feeding belt 101 facing the discharge port 85 of the casing 2 is a placement area for receiving the paper P just discharged from the discharge port 85. The conveyor unit 100 controls the drive of the feeding belt 101 such that when the paper P is discharged from the discharge port 85, the feeding belt 101 is kept stopped and receives the paper P in the placement area, and before the paper P subsequently discharged is placed on the placement area, the feeding belt 101 retreats the paper P already placed on the placement area from the placement area. This prevents the sheets of paper P from being placed one on top of the other on the feeding belt 101, thereby suppressing color shading or the like in a printed image which may be caused by the ink not uniformly dried on the paper P.

Instead of the intermittent feeding in which the feeding belt 101 feeds the already-placed paper P out of the placement area before feeding the subsequent paper P, the feeding belt 101 may continue being driven at a fixed speed.

If the sheet of paper P having a regular photograph size such as an L print is placed on the feeding belt 101, the drive of the feeding belt 101 is controlled such that the feeding belt 101 feeds the paper P toward the stacking unit 110. In contrast, if the sheet of paper P having a large size is placed on the feeding belt 101, the drive thereof is controlled such that the feeding belt 101 feeds the paper P toward the large-sized tray 104. In this manner, the feeding direction is switchable according to the size of the paper P, and thereby, the paper P can be fed to a suitable position for each paper size.

Without the large-sized tray 104, the feeding belt 101 may feed the sheet of paper P (having a regular photograph size) only in the one direction (toward the side where the stacking unit 110 is provided) of the printer right-and-left directions. In this case, the feeding belt 101 is not supposed to be driven even if the feeding belt 101 receives the sheet of paper P having a large size.

The stacking unit 110 assorts and stacks the sheets of paper P fed by the conveyor unit 100 (the feeding belt 101). The stacking unit 110 includes a box-shaped stacking body portion 111 opening on the printer front side thereof, a stacking belt 113 having no end which runs on a roller pair (not shown) provided at both upper and lower ends inside of the stacking body portion 111 such that the stacking belt 113 has a suitable tension, and a plurality of stacking plates 112 arranged at substantially regular intervals on the peripheral surface of the stacking belt 113. The roller pair is connected to a drive motor (not shown) rotating the stacking belt 113 and moving the stacking plates 112 in a conveyance direction thereof.

Among the plurality of stacking plates 112, the stacking plates 112 exposed outward from the stacking body portion 111 move downward as the stacking belt 113 rotates. On the other hand, the stacking plates 112 located inside of the stacking body portion 111 move upward as the stacking belt 113 rotates. In other words, the stacking plates 112 are continuously rotatable together with the stacking belt 113 around the roller pair.

One of the stacking plates 112 stands by in a delivery position near the downstream edge of the feeding belt 101 in the feeding direction of the sheet of paper P having a regular photograph size such that the plate surface thereof is horizontal and is flush with the surface of the feeding belt 101. The paper P is delivered from the feeding belt 101 to the stacking plate 112 in the delivery position and is stacked on the preceding paper P. After the sheets of paper P corresponding to a predetermined printing order are stacked, the sheets of paper P are fed downward by the stacking belt 113 before the sheets of paper P for the next order are fed.

Specifically, first, the sheets of paper P are stacked on the stacking plate 112 located in the delivery position (where the stacking plate 112 horizontally stands by to stack the sheets of paper P). For example, the sheets of paper P for one order are stacked on the stacking plate 112.

Next, the stacking belt 113 is driven to move the stacking plate 112 downward by the interval between the stacking plates 112. In other words, the stacking plate 112 having the sheets of paper P for the one order thereon moves downward, and thereby, the next stacking plate 112 comes to the delivery position.

The above stacking and feeding are repeated according to each order, and thereby, the sheets of paper P for each order can be stacked and fed on each stacking plate 112. Then, the operator picks up and collects the sheets of paper P stacked on each stacking plate 112.

A vertically-erected guide plate 115 is provided in the part of the stacking body portion 111 corresponding to the delivery position. The guide plate 115 stops the sheet of paper P delivered to the stacking plate 112 from the conveyor unit 100 (the feeding belt 101) (the sheet of paper P sent out of the feeding belt 101) by letting the sheet of paper P come into contact with the guide plate 115. Hence, the guide plate 115 is used for stacking the sheets of paper P on the stacking plate 112 with the front edges of the sheets of paper P in the feeding direction of the feeding belt 101 being aligned.

When the sheet of paper P too long to place on the large-sized tray 104 is discharged, the paper P is longer than the width of the feeding belt 101 of the conveyor unit 100, and thereby, the front edge of the paper P may pass the feeding belt 101 in the width direction thereof and fall from above the casing 2. In the ink jet printer A of the illustrative embodiment, therefore, a discharge tray 87 is provided on the side (the printer front side) opposite to the discharge port 85 with respect to the feeding belt 101 in the printer front-and-rear directions (the discharge direction of the paper P). The discharge tray 87 is designed to receive the long sheet of paper P.

Figure 9:
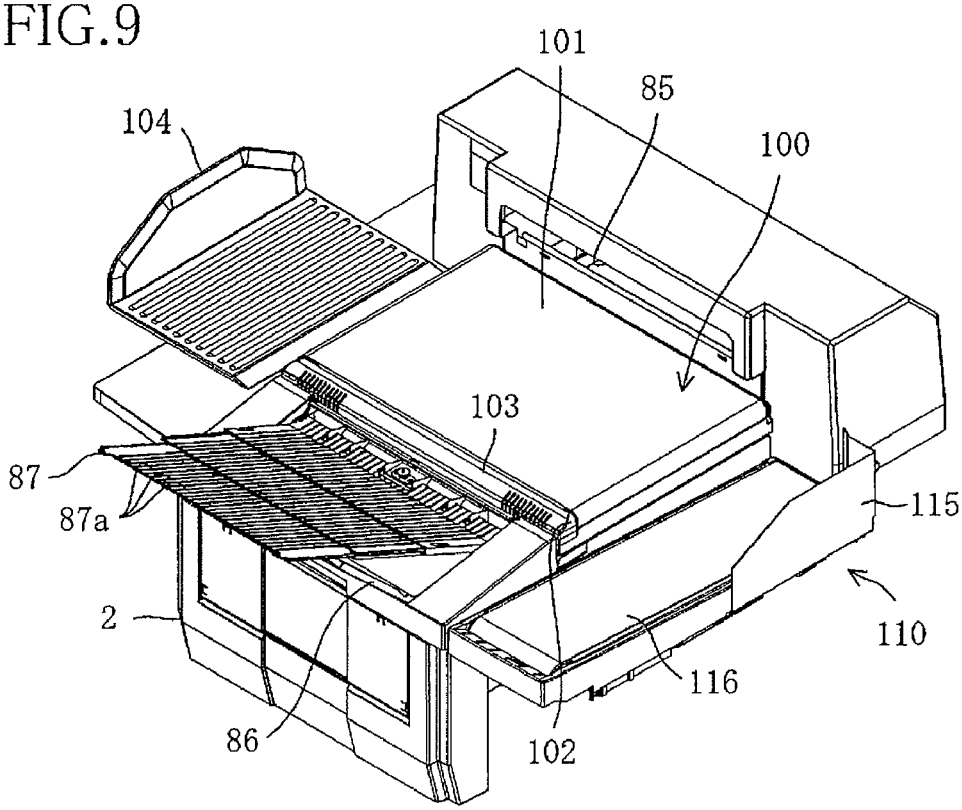
FIG. 9 is a perspective view of an upper part of an ink jet printer showing a variation of a stacking unit and a discharge tray set in a reception position.
Figure 10:
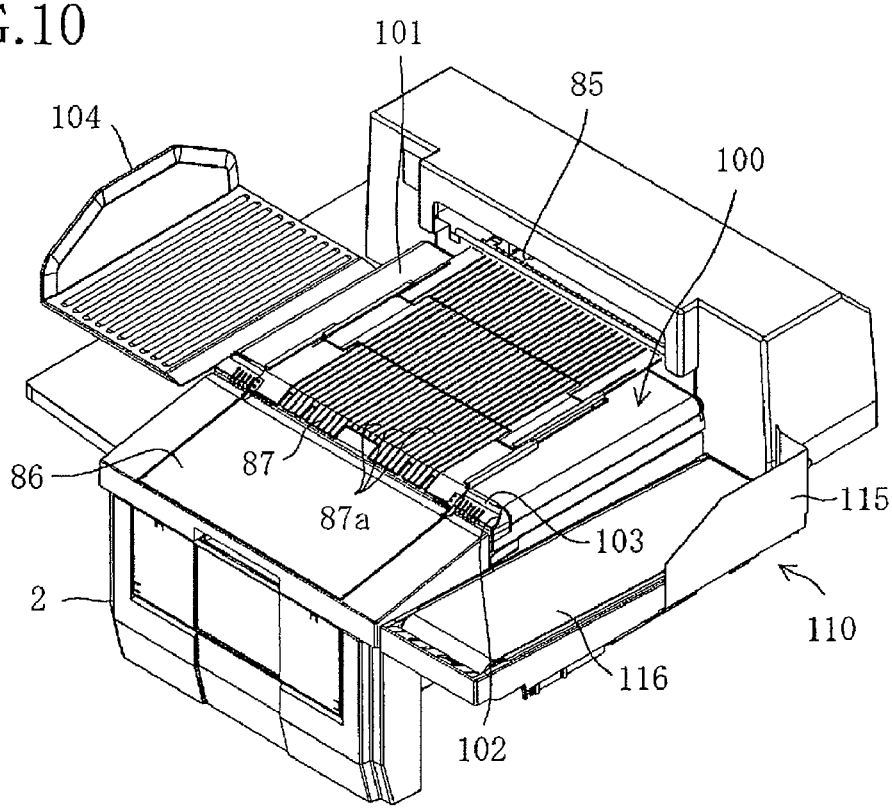
FIG. 10 is a perspective view of the upper part of the ink jet printer of FIG. 9 showing the discharge tray set in a placement position.

As described later, FIGS. 9 and 10 show a variation of the stacking unit 110 which is a conveyor type substituted for an elevator type shown in FIG. 1. Except for the stacking unit 110, the variation has the same configuration as the illustrative embodiment, and hence, a configuration of the discharge tray 87 will be below described with reference to FIGS. 9 and 10.

As shown in FIG. 9, the top part on the printer front side of the casing 2 is formed with a storage space covered in a cover 86 (see FIG. 1) openable upward, and the discharge tray 87 is stored in the storage space. The cover 86 is turnable about a pivot axis extending in the printer right-and-left directions in the edge part on the printer front side of the cover 86 closed so as to cover the storage space, and the operator can turn and open the cover 86 toward the printer front side. This turning is restricted to a turning position (below called a support position) shown in FIGS. 2 and 9 by a restriction member (not shown) so that the operator cannot turn the cover 86 from the support position toward the printer front side. Then, even if the operator releases the operator's hold of the cover 86, the cover 86 still remains in the support position by the weight of the cover 86 itself.

The discharge tray 87 is made up of a plurality of (three in the illustrative embodiment) resin plates. The state of these plates is switchable from a reduction state where the plates are placed on top of one another in the thickness directions to minimize the full length of the discharge tray 87 to a spread state where the plates are each slid and spread along the plate surfaces thereof to maximize the full length thereof, and vice versa. The discharge tray 87 is in the reduction state when stored in the storage space. The discharge tray 87 is turnable toward the side of the feeding belt 101 on a pivot axis extending in the printer right-and-left directions (the directions perpendicular to the discharge direction of the paper P) in the edge part of the discharge tray 87 placed in storage on the side of the feeding belt 101 (the printer rear side).

When the sheet of paper P too long to place on the large-sized tray 104 is discharged, in order to let the discharge tray 87 receive the paper P, the operator turns the discharge tray 87 in storage about the pivot axis and switches from the reduction state to the spread state to set the discharge tray 87 in a reception position where it is supported by the cover 86 placed in the support position. In the reception position, the discharge tray 87 is inclined upward toward the printer front side and is supported by the cover 86 in the support position (see FIGS. 2 and 9).

Each plate of the discharge tray 87 is formed on both surfaces with a plurality of ribs 87*a* extending in the discharge direction of the paper P and thereby comes into contact, in a smaller area, with the paper P. Further, the discharge tray 87 is made of a resin material, and hence, both surfaces of the discharge tray 87 (both surfaces of each plate) have a coefficient of friction lower than the surface of the feeding belt 101 made of a rubber material. Particularly, the coefficient of friction between each surface of the discharge tray 87 (each surfaces of each plate) and the paper P is lower than the coefficient of friction between the surface of the feeding belt 101 and the paper P.

In the ink jet printer A of the illustrative embodiment, the operator collects the sheet of paper P (stacked on the stacking plate 112 or placed on the large-sized tray 104) one surface of which has been printed and discharged. Then, the operator inserts the paper P from the manual tray 7 with the printed surface thereof oriented downward, and the paper P undergoes the printing processing again and thereby both surfaces thereof are printed.

The sheet of paper P discharged from the discharge port 85 after both surfaces thereof have been printed is placed on the feeding belt 101 of the conveyor unit 100 with the initially printed surface thereof oriented downward. Hence, the initially printed surface may rub against the feeding belt 101, thereby causing damage or the like to this printed surface and deteriorating the print quality of the printed surface.

On the other hand, when only one surface of the sheet of paper P is printed, the paper P is discharged onto the feeding belt 101 with the printed surface thereof oriented upward, thereby preventing the printed surface from rubbing against the feeding belt 101. As a result, the print quality of the printed surface can be maintained without deteriorating. However, when both surfaces of the sheet of paper P are printed, one of the printed surfaces rubs against the feeding belt 101. In order to feed the sheet of paper placed thereon securely up to the stacking unit 110, the feeding belt 101 is made of a rubber material or the like having a high coefficient of friction. This makes it easier to damage the printed surface rubbing against the feeding belt 101 and deteriorate the print quality of the printed surface.

Therefore, in the illustrative embodiment, using the discharge tray 87, the print quality of the printed surface can be prevented from deteriorating. Specifically, the position of the discharge tray 87 is switchable from a placement position (see FIG. 10) for covering the surface of the feeding belt 101 and receiving the sheet of paper P discharged from the casing 2 to an exposure position for exposing the surface of the feeding belt 101, and vice versa. When the discharge tray 87 is in a storage state where it is stored in the storage space, or when it is in the spread state and in the reception position, the discharge tray 87 is supposed to be in the exposure position and on the side opposite to the discharge port 85 with respect to the feeding belt 101 in the discharge direction of the paper P.

Then, the discharge tray 87 is turned (inverted) toward the feeding belt 101 about the pivot axis in the edge part of the discharge tray 87 located in the exposure position on the side of the feeding belt 101, thereby switching the position of the discharge tray 87 to the placement position. At this time, in the illustrative embodiment, the discharge tray 87 is set to the spread state such that it covers the surface of the feeding belt 101 over the full width thereof. When the discharge tray 87 is in the placement position, the cover 86 is closable (see FIG. 10), thereby preventing the cover 86 from being a hindrance.

The discharge tray 87 receives the sheet of paper P onto one surface thereof in the exposure position and onto the other surface in the placement position. However, in the illustrative embodiment, each plate of the discharge tray 87 is formed on both surfaces with the ribs 87*a*, and both surfaces of each plate have substantially the same coefficient of friction. Therefore, the surface (upper surface) of the discharge tray 87 located in the placement position has a coefficient of friction lower than the surface of the feeding belt 101 (Particularly, the coefficient of friction between the surface (the upper surface) of the discharge tray 87 located in the placement position and the paper P is lower than the coefficient of friction between the surface of the feeding belt 101 and the paper P).

The operator sets the discharge tray 87 in advance in the spread state and in the placement position before the sheet of paper P having both printed surfaces is discharged, and thereby, not the feeding belt 101 but the discharge tray 87 receives the discharged paper P directly. At this time, the printed surface (the initially printed surface) of the paper P rubs against the discharge tray 87, but the printed surface is not damaged because the surface of the discharge tray 87 has a coefficient of friction lower than the surface of the feeding belt 101. As a result, the print quality of the printed surface of the paper P can be prevented from deteriorating.

The sheet of paper P having both printed surfaces is placed on the discharge tray 87, and hence, the feeding belt 101 is not supposed to feed the paper P to the stacking unit 110. Therefore, the operator collects the paper P from the placement position.

In the illustrative embodiment, the stacking unit 110 is a so-called elevator-type stacking unit which moves the stacking plates 112 downward successively for each order. However, as shown in FIGS. 9 and 10, it may be a so-called conveyor-type stacking unit which rotates a conveyor belt 116 and moves the sheet of paper P placed on the conveyor belt 116 frontward successively for each order.

Furthermore, in the illustrative embodiment, the discharge tray 87 is turned (inverted) to switch the position thereof from the placement position to the exposure position, and vice versa, but the configuration thereof is not limited to this. For example, the discharge tray 87 may be configured to be attachable to and detachable from the casing 2 in each of the placement position and the exposure position. If necessary, the operator attaches the discharge tray 87 to the casing 2 in the placement position or the exposure position. Moreover, the state of the discharge tray 87 is switchable from the reduction state to the spread state, and vice versa, but the discharge tray 87 may be configured such that the length thereof in the spread state is fixed. In this case, when the discharge tray 87 is located in the exposure position, the discharge tray 87 can be set in the reception position for receiving the sheet of paper P too long to place on the large-sized tray 104.

In addition, in the illustrative embodiment, when both surfaces of the sheet of paper P are printed, the operator collects the paper P one surface of which has been printed and discharged and inserts the paper P from the manual tray 7 with the printed surface oriented downward. However, the ink jet printer A may print both surfaces of the sheet of paper P automatically.

Furthermore, in the illustrative embodiment, the ink jet printer A is described as an example of the image forming apparatus of the present invention. However, the present invention may be applied to any image forming apparatus discharging a sheet of printed paper from a casing through a discharge port of the casing.

The above illustrative embodiment is merely an illustration and the scope of the present invention should not be limitedly interpreted. The scope of the present invention should be defined by the claims, and all variations and modifications that fall within metes and bounds of the claims or equivalence of such metes and bounds can be implemented within the scope of the present invention.

What is claimed is:

1. An image forming apparatus allowing a printing section inside of a casing to print paper and discharging the printed paper from the casing through a discharge port of the casing, comprising:

a feeding belt configured to receive the paper discharged from the casing, and to feed the received paper; and a discharge tray configured such that the position thereof is switchable from a placement position for covering the surface of the feeding belt and receiving the paper discharged from the casing to an exposure position for exposing the surface of the feeding belt, and vice versa, wherein a surface of the discharge tray has a coefficient of friction lower than the surface of the feeding belt.

2. The image forming apparatus of claim 1, wherein the feeding belt is arranged in front of the discharge port in a direction where the paper is discharged and extends perpendicularly to the discharge direction, and when the discharge tray is in the exposure position, the discharge tray is located opposite to the discharge port with respect to the feeding belt in the discharge direction of the paper and turns toward the feeding belt on a pivot axis extending perpendicularly to the discharge direction of the paper at the edge of the discharge tray located in the exposure position on the side of the feeding belt, and thereby, the position of the discharge tray changes to the placement position.

* * * * *